United States Patent [19]

Tudor

[11] Patent Number: 4,793,478

[45] Date of Patent: Dec. 27, 1988

[54] CIGARETTE PACKAGE AND THE LIKE

[75] Inventor: Thomas T. Tudor, Crestwood, Ky.

[73] Assignee: Brown & Williamson Tobacco Corporation, Louisville, Ky.

[21] Appl. No.: 65,546

[22] Filed: Jun. 24, 1987

[51] Int. Cl.[4] ..... B65D 85/10

[52] U.S. Cl. ..... 206/256; 206/276

[58] Field of Search ..... 206/256, 268, 276, 433, 206/523

[56] References Cited

U.S. PATENT DOCUMENTS

| | | | |
|---|---|---|---|
| Re. 31,076 | 11/1982 | Herman | 206/256 X |
| 1,574,566 | 2/1926 | Fiske | 206/256 X |
| 3,159,272 | 12/1964 | Swift | 206/256 X |
| 4,173,286 | 11/1979 | Stanko | 206/433 |
| 4,294,349 | 10/1981 | Ibsen et al. | 206/523 X |

FOREIGN PATENT DOCUMENTS

| | | | |
|---|---|---|---|
| 1935644 | 7/1969 | Fed. Rep. of Germany | 206/268 |
| 831099 | 5/1938 | France | 206/256 |
| 1028686 | 2/1953 | France | 206/256 |
| 605222 | 7/1948 | United Kingdom | 206/256 |

*Primary Examiner*—Joseph Man-Fu Moy

*Attorney, Agent, or Firm*—Charles G. Lamb

[57] ABSTRACT

In one embodiment, a cigarette package includes a block section formed with a plurality of spaced apart, parallel bores open to the top of the block section. Each of the bores receives an individual cigarette which cigarette protrudes from the top of the block section. A cover is removably positioned at the top of the block section to enclose the protruding ends of the cigarettes.

In another embodiment, a cigarette package includes a box section having an open top end and a cover hinged to a wall of the box section for movement between a closed position covering the open box top and an open position away from the box top. A block section of material fits within the box section such that the top end of the block section is at the open top end of the box section. The block section is formed with a plurality of spaced apart, parallel bores having their longitudinal axes parallel to the walls of the box section, and open to the top end of the block section and, therefore, also open to the top end of the box section. Each of the bores receives an individual cigarette which cigarettes protrude from the top end of the block section.

3 Claims, 3 Drawing Sheets

CIGARETTE PACKAGE AND THE LIKE

BACKGROUND OF THE INVENTION

The present invention relates to cigarette packages, and more particularly to cigarette packages for containing a plurality of cigarettes and allowing for the extraction thereof of cigaretes one at a time without disturbing the other cigarettes in the package.

Various cigarette packages have been proposed to accomplish the above objective. The following U.S. patents are representative of such known packages.

U.S. Pat. No. 1,158,826 teaches a cigarette package. The package consists of a cardboard outer box having a hinged top cover closing the open top of the box. The package also has a hinged bottom cover closing the open bottom of the box. With reference to FIGS. 2 and 4, an insert in the box is folded back and forth to form a series of elongated cigarette containing compartments. Alternating ones of the compartments are open to the open box top and the open box bottom. Each compartment holds one cigarette. In FIGS. 5 and 7, the box insert is corrugated to form elongated cigarette containing compartments.

U.S. Pat. No. 1,160,930 is by the same inventor as U.S. Pat. No. 1,158,826 and teaches a cigarette box essentially identical to that of his prior patent except for details of construction wherein the ends of the cigarettes extend upwardly beyond the top ends of the insert forming the elongated cigarette compartments.

U.S. Pat. No. 1,164,782 teaches a flat cigarette box having a corrugated insert forming spaced apart partitions. Cigarettes are located in the spaces between adjacent cigaretes.

U.S. Pat. No. 1,174,872 teaches a cigarette box which has two removable trays. Each tray has spaced apart partitions forming a number of cigarette containing compartments. When the cigarettes of one tray are used up, that tray is removed to gain access to the cigarettes contained in the other tray.

U.S. Pat. No. 1,870,299 teaches a cigarette package fabricated to two layers of paper or the like. One paper layer is flat and the other paper layer is formed with a plurality of side-by-side loops. The two layers are adhesively attached to each other. The loops in one layer form compartments for individual cigarettes.

U.S. Pat. No. 2,528,743 teaches a cigarette case having an insert 11. The insert 11 has a back wall 16, two side walls 17 and 18, and a bottom ledge 19. The top and front sides of the insert 11 are open. A bar 22 extends across the open front side of the insert. The bar 22 has grooves which cooperate with the insert back wall 16 for holding individual cigarettes.

U.S. Pat. No. 3,033,419 teaches a cigarette box having an insert of fluted stiff paper defining elongated channels for holding individual cigarettes. At the bottom end of each compartment is a paper spring which abuts the bottom end of the cigarette and biases the cigarettes upwardly to project out of the top end of each compartment.

U.S. Pat. No. 3,165,249 teaches a cigarette box which has a portion of its front wall hinged so that it can be pivoted outwardly. The cigarettes in the box are individually encased between two layers of plastic. The top edge of the hinged portion of the front wall has a cutting edge for cutting the cigarettes free from the encasing layers of plastic.

SUMMARY OF THE INVENTION

The present invention provides a cigarette package containing a plurality of cigaretes in parallel spaced apart relationship providing for the removal of individual cigarettes without disturbing the other cigarettes remaining in the package.

More particularly, in one embodiment, the present invention provides a cigarette package for containing a plurality of cigarettes comprising a block section of material formed with a plurality of generally cylindrical, spaced apart, parallel bores open to the top end of the block section, each of the bores receiving longitudinally therein a cigarette so that one end of the cigarette protrudes from the top end of the block section, and a cover removably positioned at the top end of the block section to enclose the protruding ends of the cigarettes.

In another embodiment the present invention provides a cigarette package for containing a plurality of cigaretes comprising a box having a closed bottom end, a front wall extending upwardly from the bottom end, a rear wall extending upwardly from the bottom end, two spaced apart side walls extending upwardly from the bottom end and interconnecting the front and rear walls, and an open top end defined by the top edges of the front wall, rear wall and side walls; a cover hinged to the rear wall of the box for pivotal movement between a closed position closing the open top end of the box and an open position away from the open top end of the box; and, a block section of material located within and dimensioned to substantially fill the box with the top end of the block section is located at the open top end of the box, the block section being formed with a plurality of generally cylindrical, spaced apart, parallel bores with the longitudinal axes of the bores generally parallel to the walls of the box and having at least one end open to the top end of the block section and open top of the box, each of the bores receiving longitudinally therein a cigarette so that one end of the cigarette protrudes from the top end of the block section.

BRIEF DESCRIPTION OF THE DRAWINGS

A better understanding of the present invention will be had upon reference to the following description in conjunction with the accompanying drawings in which like numerals refer to like parts and wherein.

DETAILED DESCRIPTION OF THE PREFERRED EMBODIMENT

Figure 1:
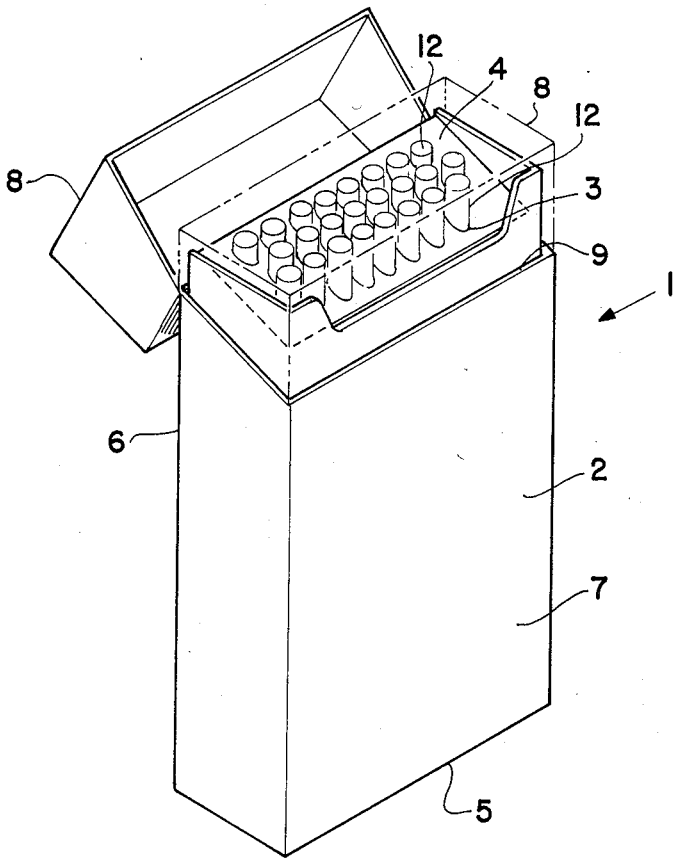
FIG. 1 is a perspective view of one advantageous embodiment of a cigarette package of the present invention.

With reference to FIG. 1, there is shown a first advantageous embodiment of a cigarette package 1 of the present invention containing a plurality of cigarettes 12.

The cigarette package 1 comprises a block section 2 formed with a plurality of generally cylindrical, spaced apart, parallel blind-ended cigarette receiving bores 3, each bore 3 having an open end at the top end 4 of the block section 2. The height of the block section 2 measured from the bottom end 5 to the top end 4 of the block section 2 is less than the length of the cigarettes 12 to be contained so that the cigarettes 12 will project or protrude from the open ends of the bores 3 above the top end 4 of the block section 2. The cigarette receiving bores 3 are arranged in parallel rows extending across the width of the block section 2.

As shown, the top end 4 of the block section 2 is slanted downwardly from the rear wall 6 of the block section 2 toward the front wall 7 of the block section 2, thus, the cigarettes 12 of each succeeding row progressing from the rear wall 6 to the front wall 7 of the block section 2 project above the top end 4 of the block section by a greater dimension than the cigarettes of a preceding row.

The block section 2 can be fabricated of virtually any convenient material which is lightweight, chemically inert to tobacco, and moisture resistant. Suitable such materials include, for example, wood, or expanded foam such as polyethylene, polypropylene, and the like. The cigarette package 1 further includes a cover 8 for covering the top end 5 of the block section 2 and enclosing the protruding ends of the cigarettes 12. As shown, the cover 8 is hinged to the rear wall 6 of the block section 2 for movement from an open position as shown in solid lines in FIG. 1 to a closed position shown in phantom lines in FIG. 1. The block section 2 can be formed wih a peripheral ledge 9 below the top end 5 to mate with the peripheral edge of the cover 8 when it is in the closed position.

Figure 2:
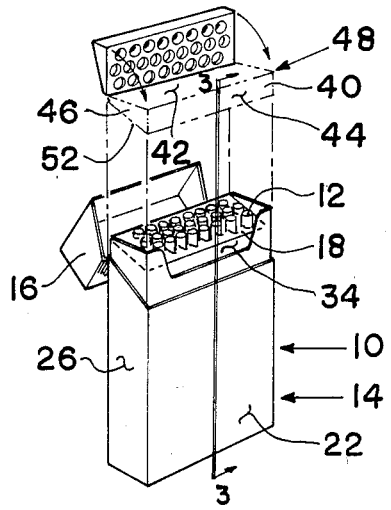
FIG. 2 is a perspective view of another advantageous embodiment of a cigarette package of the present invention.
Figure 3:
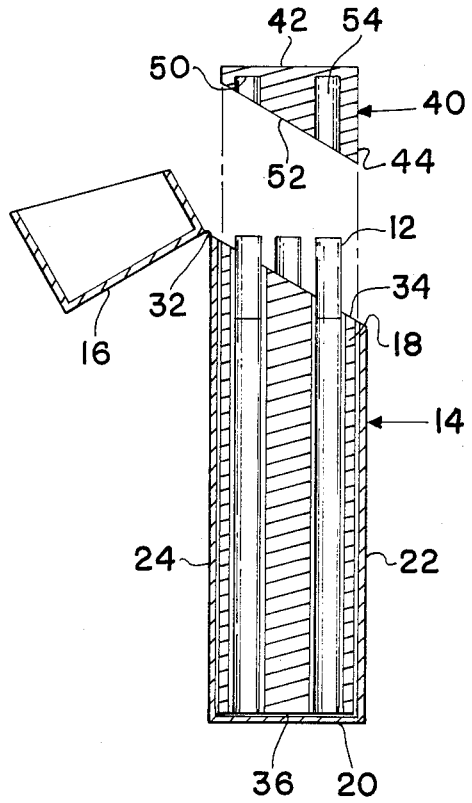
FIG. 3 is a cross-sectional view of the package of FIG. 2 as seen in the direction of arrows 3—3 in FIG. 2.

With reference to FIGS. 2 and 3, there is shown a second advantageous embodiment of a cigarette package 10 of the present invention containing a plurality of cigarettes 12.

The cigarette package 10 comprises a box 14 with a cover 16 and cigarette holding insert block section 18.

Figure 4:
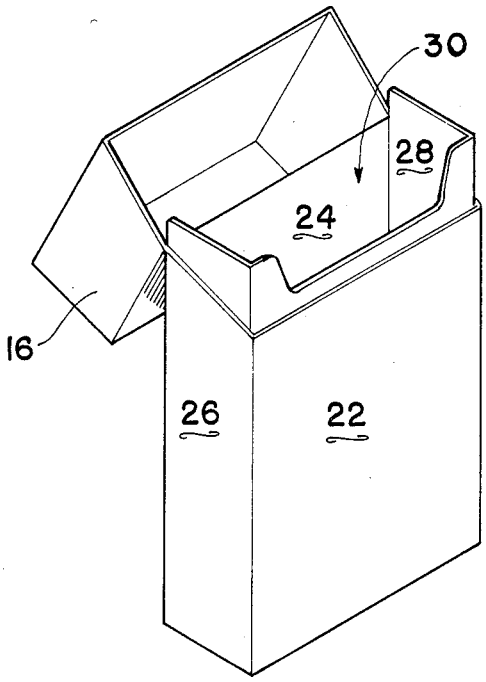
FIG. 4 is a perspective view of one component of the package of FIG. 2; and, FIG. 5 is a perspective view of another component of the package of FIG. 2.

With continued reference to FIGS. 2 and 3, and additional reference to FIG. 4, the box 14 comprises a closed bottom end 20, a front wall 22 extending upwardly from the bottom end 20, a rear wall 24 extending upwardly from the bottom end 20 in spaced parallel alignment with the front wall 22, and two spaced apart, parallel side walls 26 and 28 extending upwardly from the bottom end 20 and interconnecting the front wall 22 and rear wall 24. The box 14 has an open top end 30 defined by the top edges of the front wall 22, rear wall 24, and side walls 26, 28. The cover 16 is hinged to the rear wall 24 as indicated by the numeral 32 for pivotol movement between an open position (shown in FIGS. 1, 2, and 3) away from the open top end 30 of the box 14 and a closed position closing or covering the open top end 30 of the box 14. The cover 16 can be integrally attached to the rear wall 24 at the top edge thereof and the hinge 32 can be a fold along the top edge of the box rear wall 24. The box 14 and cover 16 can be fabricated of virtually any material, however, a thick paper or plastic materials is preferred.

Figure 5:
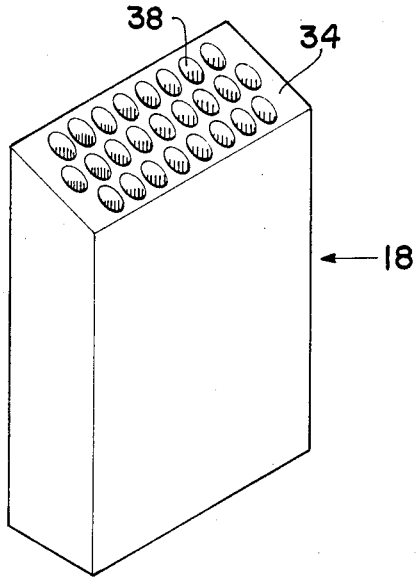

With reference now to FIGS. 2, 3, and 5, the cigarette holding insert block section 18 is sized and configured to fit in the enclosure defined by the box 14 with the top end 34 of the block section 18 located at the open top end 30 of the box 14 and the bottom end 36 of the block 18 resting on the closed bottom end 20 of the box 14. The block section 18 is also formed with a plurality of generally cylindrical, spaced apart, parallel cigarette receiving bores 38 with the longitudinal axes of the bores 38 generally parallel to the walls 22, 24, 26, and 28 of the box 14 and having an open end open to the top end 34 of the block section 18 and, therefore, open to the open top 30 of the box 14. The height of the block section 18 measured from the bottom end 36 to the top end of the block section 18 is less than the length of the cigarettes 12 to be contained so the cigarettes 12 will project or protrude from the open ends of the bores 38 above the top end 34 of the block section 18. The bores 38 are arrayed in parallel rows extending across the width of the block section 18 and, therefore, also across the width of the box 14. And, the bores 38 of each row are staggered with respect to the bores 38 of adjacent rows. As a manufacturing expedient, the cigarette receiving bores 38 can be formed entirely through the block section 18 so the bores 38 are also open at the bottom end 36 of the block section 18 in which case the bottom ends of the cigarettes 12 in the bores 38 will rest on the closed bottom end 20 of the box 14.

As best shown in FIGS. 2, 3, and 5, the top end 34 of the block section 18 is slanted downwardly from the rear wall 24 of the box 14 toward the front wall 22 of the box 14. Thus, the cigarettes 12 of each succeeding row of cigarettes, progressing from the box rear wall 24 to the box front wall 22, project above the top end 34 of the block section by a greater dimension than the cigarettes of a preceding row. Further, the top edge of the box front wall 22 is at an elevation below that of the top edge of the box rear wall 24.

The cigarette holding block section 18 can be fabricated of virtually any convenient material. The selected material should be lightweight, chemically inert to tobacco, and moisture resistent. Suitable materials include, for example, wood, or expanded plastic foam such as polyethylene, polypropylene, and the like.

It is contemplated that the cigarette holding block section could be manufactured of one piece, or alternatively of a plurality of sections assembled to form the block section 18. For example, the sections could be made with two symmetrical half sections with facing surfaces having semi-cylindrical spaced apart, parallel grooves such that when the half sections are placed in surface facing contact the grooves cooperate to form the cigarete receiving bores 38.

As shown in FIGS. 2 and 3, the cigarette package 10 further comprises a block section cover 40 for enclosing the ends of the cigarettes 12 protruding from the top end 34 of the block section 18 to protect the cigarettes during storage and shipment. As shown, the block section cover 40 has a top surface 42, a front surface 44 perpendicular to the top surface 42, two spaced apart side surfaces 46, 48 perpendicular to the top surface 42 and front surface 44, a rear surface perpendicular to the top surface 42 and side surfaces 46, 48, and a slanted bottom surface which mates with the slanted top end 34 of the block section 18 when the block section cover 40 is in place over the top end 34. The box cover 40 encloses the protruding ends of the cigarettes 12 and cooperates with the block section 18 to form a rectangular solid conforming to the interior and size shape of the cigarette box 14 when the box cover 16 is closed. The block section cover 40 can be formed with a hollow interior defined by the cover top surface 42, front surface 44, side surfaces 46, 48 and rear surface 50 and open at the bottom surface 52. Alternatively, as shown in FIG. 2, the block section cover 40 can be formed with a plurality of cylindrical, spaced apart, parallel, cigarette end receiving pockets 54 open to the slanted bottom surface 52 of the block section cover 40. The number and spacing of the pockets 54 corresponds to the number and spacing of the cigarette receiving bores 38 such that the protruding end of each cigarette is received within a different one of the cigarette receiving pockets 54. It is contemplated that the block section cover can be fabricated of the same material as the cigarette receiving block section 18.

Typically, cigarettes 12 in a cigarette package are covered with a foil material to protect the cigarettes from moisture. It is contemplated that such a foil protective material be affixed to the block section cover 40 so that when the foil is removed by a user the cover 40 is also removed with the foil in one operation.

The foregoing detailed description is given primarily for clearness of understanding and no unnecessary limitations are to be understood therefrom for modification will become obvious to those skilled in the art upon reading this disclosure and can be made without departing from the spirit of the invention or scope of the appended claims.

What is claimed is:

1. A cigarette package for containing a plurality of cigarettes comprising:

a box having a closed bottom end, a front wall extending upwardly from the bottom end, a rear wall in spaced apart parallel relationship to the front wall and extending upwardly from the bottom end, the front wall of the box is at a lower elevation than the top edge of the back wall, two spaced apart, parallel side walls perpendicular to and interconnecting the front and rear walls, and an open top;

a box cover hinged to the rear wall of the box for pivotal movement between a closed position covering the open top of the box and an open position away from the open top of the box; and, a cigarette holding block section fitted within the box with the top end of the block section located at the open top end of the box being slanted downwardly from the rear wall of the box to the front wall of the box, the block section being formed with a plurality of generally cylindrical, spaced apart, parallel cigarette receiving bores with the longitudinal axes of the bores being generally parallel to the walls of the box, the bores extend entirely through the block section and are open to both the top end of the block section and the bottom end of the block section, having an open end open to the top end of the block section, the cylindrical bores are arrayed in parallel rows extending along the width of the block section, the bores of each row are staggered with respect to the bores of the adjacent rows, and the height of the block section measured from the bottom end to the top end being less than the length of a cigarette contained in the bores so that each of the cigarettes rest at its bottom end on the bottom end of the box and protrudes from the open ends of the bores above the top end of the block section.

2. The cigarette package of claim 1 further comprising a removable block section cover for enclosing the protruding end of the cigarettes in the bores of the block section.

3. The cigarette package of claim 2 wherein the block section cover has a slanted bottom side which mates with the slanted top end of the block section so that the block cover and block section cooperate to form a rectangular solid enclosed by the box and box cover.

* * * * *